US006415966B1

(12) United States Patent
Pradinas et al.

(10) Patent No.: US 6,415,966 B1
(45) Date of Patent: Jul. 9, 2002

(54) PUSH-PULL CLOSURE COMPRISING A DOUBLE SAFETY SEAL

(75) Inventors: Claude Pradinas, Couzon Au Mont d'Or; Yves Jolivet, Anse; Michel Luzzato, Lyons, all of (FR)

(73) Assignee: Novembal, Levallois Perret (FR)

( * ) Notice: Subject to any disclaimer, the term of this patent is extended or adjusted under 35 U.S.C. 154(b) by 0 days.

(21) Appl. No.: 09/831,447

(22) PCT Filed: Dec. 15, 1999

(86) PCT No.: PCT/FR99/03146

§ 371 (c)(1),
(2), (4) Date: May 10, 2001

(87) PCT Pub. No.: WO00/35767

PCT Pub. Date: Jun. 22, 2000

(30) Foreign Application Priority Data

Dec. 16, 1998 (FR) ..... 98 15892

(51) Int. Cl.[7] ..... B67D 3/00
(52) U.S. Cl. ..... 222/519
(58) Field of Search ..... 222/212, 213, 222/494, 520, 519, 521, 525, 549, 548, 553, 556

(56) References Cited

U.S. PATENT DOCUMENTS

| | | | | | |
|---|---|---|---|---|---|
| 3,731,849 | A | * | 5/1973 | Burrows | 222/520 |
| 5,328,062 | A | * | 7/1994 | Beck et al. | 222/521 |
| 5,456,374 | A | * | 10/1995 | Beck | 222/549 |
| 5,588,562 | A | * | 12/1996 | Sander et al. | 222/520 |
| 5,662,247 | A | * | 9/1997 | Rapchak et al. | 222/520 |
| 5,813,575 | A | * | 9/1998 | Glynn et al. | 222/520 |

FOREIGN PATENT DOCUMENTS

| | | |
|---|---|---|
| FR | 2768131 | 3/1999 |
| WO | 9613442 | 5/1996 |
| WO | 9722530 | 6/1997 |

* cited by examiner

*Primary Examiner*—William C. Doerrler
*Assistant Examiner*—Thach H. Bui
(74) *Attorney, Agent, or Firm*—Dowell & Dowell, P.C.

(57) ABSTRACT

A push-pull closure which includes a base for securing to a container and which base includes an upper plug which seats within an opening in a valve lifter which is moveable with respect thereto between a closed position and an open position and wherein a cap is provided for covering the valve lifter when in a closed position. A tamper indicating seal is applied over a portion of the top of the valve lifter and the plug of the base in order to provide a seal therebetween and to provide evidence of tampering or of first opening of the valve lifter from the closed position to the open position.

7 Claims, 1 Drawing Sheet

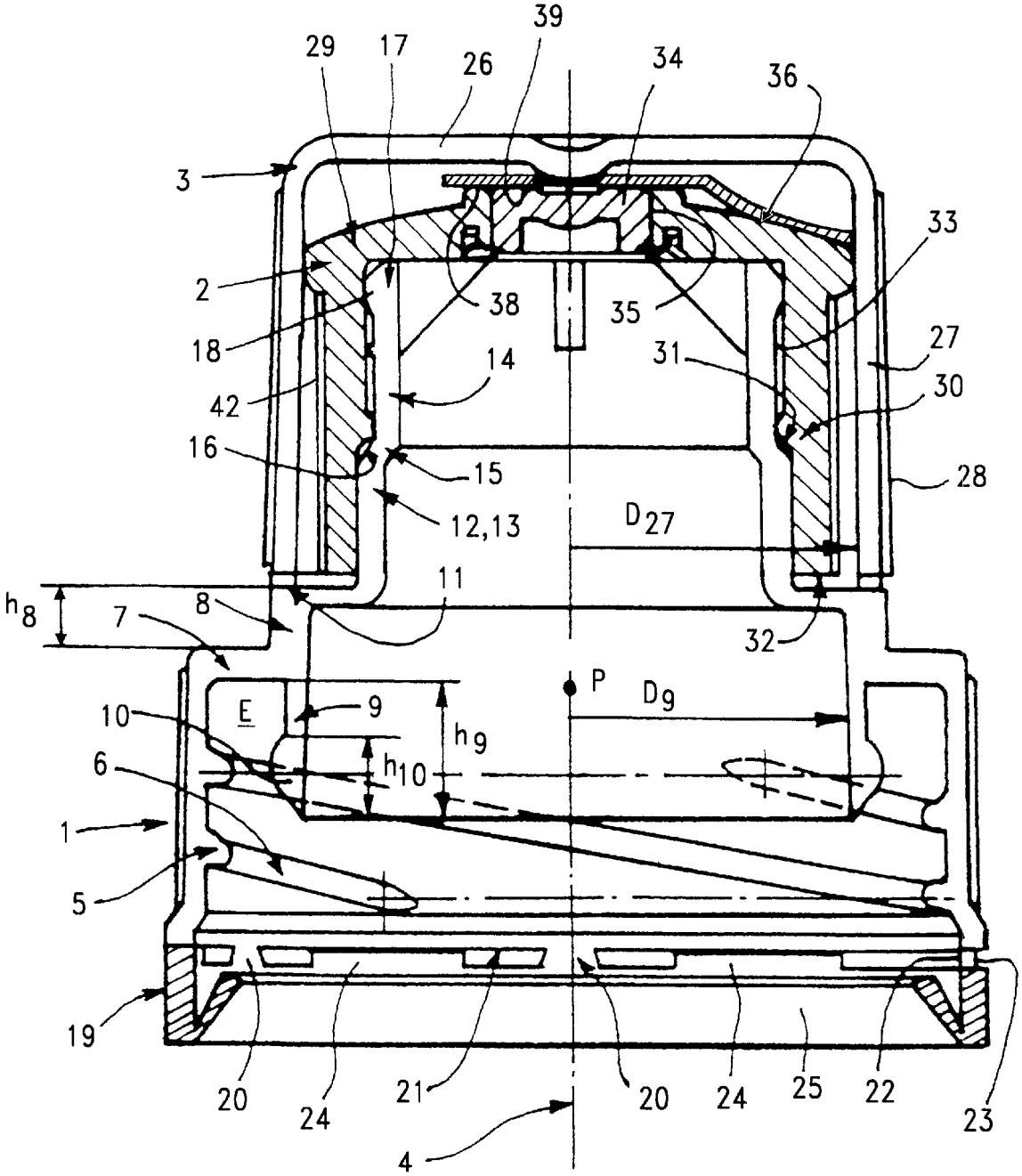
39
29
17
26
34
36
3
33
2
38
35
18
14
31
27
42
30
16
15
28
12,13
D27
11
h8
7
8
32
P
D9
10
E
9
h9
6
h10
1
5
19
20
24
21
20
24
25
22
23
4

PUSH-PULL CLOSURE COMPRISING A DOUBLE SAFETY SEAL

BACKGROUND OF THE INVENTION

1. Field of the Invention

The invention relates to push-pull type closures which make it possible to drink directly from a neck of a bottle.

2. Description of the Related Art

Such closures are conventionally composed of a base, a valve lifter and a protective cap, as is seen, for example, in U.S. Pat. No. 5,813,575.

The cap and/or the valve lifter may be provided with tell-tales or tamper indicating components for showing tampering. Such tamper indicating components complicate the manufacturing of molds, molding and assembly of the three parts.

SUMMARY OF THE INVENTION

The invention has for its object to provide a closure system of the type set forth hereinabove comprising a perfect sealing means before opening and forming a tamper indicator upon first opening.

To this end, the invention relates to a push-pull closure which includes a base provided with an internal thread, a valve lifter associated with the base and movable relatively to the base between a closing position and an opening position, and a cap covering the valve lifter before the closure is opened for a first time, and wherein the closure comprises a tamperproof inner seal welded or adhered on a top part of the valve lifter.

An outer lateral skirt of the base is extended along its lower part by a tamperproof band connected by frangible lugs to a lower edge of the skirt.

The frangible bridges or lugs are separated from one another by zones of abutment abutting against the lower edge of the outer lateral skirt when the closure is positioned on a neck of a recipient or container.

The valve lifter comprises a convex top extended, in its lower part, by an annular wall of which the shape of the inner surface corresponds substantially to an outer surface of an upper part of the base. The wall of the valve lifter comprises an inner shoulder abutting, when the valve lifter is in a closed position, against a surface of a shoulder of the base. The inner surface of the wall is, in its upper part, in contact with a bead defining an end zone of the base. Clips inside a cap are in register with the bottom wall of the valve lifter so as to secure the cap upon reclosure.

BRIEF DESCRIPTION OF THE DRAWING

Other objects and advantages of the invention will be more clearly understood in the course of the following description of an embodiment with reference to the accompanying Drawing FIGURE which is a longitudinal cross section of a closure system according to the invention.

DESCRIPTION OF THE PREFERRED EMBODIMENT

In the following text, the terms "upper", "lower", "top", "outer", "inner" will be employed, unless mentioned to the contrary, with reference to a point P located at a center of the closure system.

The closure system shown comprises three parts, a base 1, a valve lifter 2 and a cap 3. The assembly is a revolution about a vertical axis 4, in the embodiment shown.

The base 1 comprises an outer lateral skirt 5 provided with an internal thread 6. At the top of the outer lateral skirt there extends a substantially horizontal annular wall 7 which is perpendicular to the outer, lateral skirt. The annular wall 7 is inwardly limited by a substantially vertical wall 8 which is concentric to the outer lateral skirt 5.

The wall 8 extends upwardly over a height $h_8$ and extends downwardly, below the surface formed by the wall 7, to form an inner annular skirt 9 concentric to the outer lateral skirt 5. The inner skirt 9 comprises, in its lower end, an outer annular bead 10 forming a sealing lip. In the embodiment shown, the bead 10 extends over a height $h_{10}$ of the order of half of the vertical dimension $h_9$ of the inner skirt 9 or of height $h_8$.

The outer and inner skirts define, over height $h_9$, an annular space E limited upwardly by wall 7 and open downwardly. An upper surface 11 of the wall 8, which is substantially horizontal, forms a surface of abutment for a lower edge of a skirt of cap 3.

An upper part 12 of the base 1 comprises two cylindrical zones 13, 14 of decreasing diameter, from bottom to top, separated by a shoulder 15. The shoulder 15 defines a truncated outer annular surface 16, abutting against a complementary surface 31 of the valve lifter 2, when the closure is in a closed position. The zone 14 includes, near its free edge 17, an outer annular sealing bead 18.

The outer lateral skirt 5 of the base 1 is extended in its lower part by a tamperproof band 19. This tamperproof band 19 is connected by frangible bridges or lugs 20 to a lower edge 21 of the skirt 5. An upper part of the frangible bridges 20 are of reduced cross section compared to their lower part. These frangible bridges 20 are, in the embodiment shown, substantially triangular. The bridges are limited inwardly by a substantially vertical surface 22 and, outwardly, by a surface 23 inclined with respect to the vertical.

The geometry of the bridges 20 facilitates their rupture or fracturing in a vicinity of their areas of attachment with the tamperproof band 19, when the closure is initially opened.

Bearing surfaces 24 separate the frangible bridges 20 from one another. These bearing surfaces 24 form crenelations. A distance between the lower edge 21 of the skirt 5 and the bearing surfaces 24 is very small and much less than a height of the frangible bridges 20.

Consequently, when the closure is positioned on the neck of a recipient or container (not shown), the bearing surfaces 24 abut against the lower edge 21 of the skirt 5. In this manner, premature rupture of the frangible bridges 20 is prevented.

An annular lip 25 extends a lower portion of the tamperproof band 19. The lip 25 is turned inwardly, in manner known per se, when the closure is positioned on the neck of the recipient.

The base 1 may be made of a plastic material such as polypropylene or polyethylene.

The cap 3 comprises a body formed by a transversal top wall 26 and a lateral annular skirt 27 which is slightly truncated, widening downwardly. A maximum internal diameter $D_{27}$ defined by the skirt 27 is slightly larger than an internal diameter $D_9$ defined by the inner skirt 9 of the base 1.

In one embodiment, the cap 3 comprises outer grooves or recesses 28 to facilitate gripping. In another embodiment, at least a part of the outer surface of the cap 3 is granite like.

The valve lifter 2 comprises a convex top wall 29 extended, at its lower part, by an annular wall 30. An inner surface of the wall 30 is of a shape substantially corresponding to the outer surface of zones 13 and 14 of the base 1. In particular, a shoulder 31, inside the wall 30, comes into abutment, when the valve lifter 2 is in a closed position, against the surface 16 of the shoulder 15 of the base 1.

However, a lower edge 32 of the wall 30 does not abut the surface 11 of the wall 8 of the base 1 when the valve lifter 2 is in the closed position. Similarly, an inner surface 33 of the wall 30 is, at its upper part, in contact with the outer bead 18 of the zone 14 of the base 1.

Consequently, the valve lifter 2 is mounted on the upper part of the base 1 so as to create a seal in closed or pushed in position and to permit flow in a pulled or open position.

In order to secure the cap 3 upon reclosure, clips 42 inside the cap 3, or equivalent, engage with an annular edge of the top wall 29 of the valve lifter 2.

A seal with the neck of the bottle (not shown) is ensured by the annular sealing lip 10.

In order to increase a hold of the caps 3 during screwing of the caps on a production line, notches may be made at the base of the caps so that they are in register with other notches made on the surface of the bases which function as bearing surfaces for the skirts 27 of the caps. Such notches make it possible to prevent rotation of the caps with respect to the bases when the closures are being screwed to containers, on the production line. The notches do not hinder rotation of the caps in the sense of opening, for example anti-clockwise, but prevent rotation in the sense of screwing the caps to containers.

The caps 3 may be made of translucent or semi-transparent material so as to allow the color of the valve lifters to appear. The color may be associated, for example, with contents of a receptacle on which the closures are applied.

A plurality of ribs made on the bases and on the caps, prevents mutual rotation of these two pieces.

A peelable inner seal 36 is secured, by adhesion, heat-sealing or any other equivalent process, above a plug 34 and the upper face 38 of the convex bottom wall 29 of the valve lifter 2 to therefore form a seal 39 between an opening 35 in the valve lifter 2 which is normally sealed by the plug 34.

This upper face and the upper face of the plug 34 are, before first opening, substantially in the same plane, which facilitates the positioning of the peelable inner seal. The plug is integrally formed with the base 1 and extends above the outer bead 18 thereof. A plurality of peelable materials, known per se, may be used for making the peelable secondary seal; such as aluminum polyethylene complexes, multilayers or laminates including ethylene-vinyl alcohol copolymer resin (EVOH) and the like.

The seal with the neck of the container is conserved when the closure is unscrewed until the bridges 20 joining the tamperproof band 19 to the outer lateral skirt 5 are broken. The seal of the closure is also accomplished by the plug 34 of the base 1. Lateral surfaces of the plug seat and seal with the walls defining the opening 35 in the valve lifter 2.

In the embodiment shown, the inner surfaces of the opening 35 includes a substantially vertical inner annular wall, a first substantially horizontal annular lower wall, a truncated upwardly tapering annular wall inclined by an angle included between 10 and 20 with respect to the vertical, a second substantially horizontal outer annular wall, and a substantially outer vertical annular wall.

The second substantially horizontal wall lies in a plane placed above the plane including the first substantially horizontal wall.

The plug includes from its upper edge towards its lower edge, a substantially vertical lateral surface, a first substantially horizontal lateral surface, a truncated annular surface inclined by an angle included between 10 and 20 with respect to the vertical, a second substantially horizontal lateral surface, a joining surface, and a substantially vertical surface. The truncated surface, second horizontal surface outer vertical surface form a lateral annular portion of the plug.

When the valve lifter 2 is closed, the outer annular recess of the opening 35 receives the lateral annular portion of the plug 34. Thus, the truncated annular wall of the opening 35 comes into abutment against the truncated surface of the plug 34 and the first substantially horizontal annular wall of the opening comes into abutment against the first substantially horizontal surface of the plug. Further, the substantially vertical lateral surfaces of the plug are substantially in contact over their whole of their length with the substantially vertical annular walls of the opening 35.

The bridges 20 joining the tamperproof band 19 to the lateral skirt 5 may be broken when the user desires for example to fill the container again. Consequently, the closure system is doubly tamperproof. First, the tamperproof nature is associated with the presence of a peelable, inner secondary seal 36, and second, the tamperproof nature is associated with an initial unscrewing of the base 1 with respect to the neck of the container to rupture the lugs 20.

What is claimed is:

1. A closure of a push-pull type for use with a container having a mounting portion on which the closure is mounted, the closure including; a base provided with a skirt having means for securing the closure to the mounting portion of a container, the base having an upper portion from which extends a plug member, a valve lifter mounted about the upper portion of the base and moveable relative to the plug member between a closed position wherein the plug member is seated within an opening in the valve lifter to thereby create a seal between the base and the valve lifter and an open position wherein the plug member is spaced from the opening in the valve lifter to permit liquid flow therebetween, a cap covering the valve lifter before the valve lifter is moved to the open position for a first time, and wherein a tamper indicating inner seal is provided over a portion of a top part of the valve lifter and the plug member to thereby provide a further seal between the plug member and the valve lifter until the valve lifter is moved to the open position for the first time.

2. The closure according to claim 1 wherein the skirt of the base includes a lower edge, a tamper indicating band extending from the lower edge of the skirt and being connected thereto by a plurality of spaced frangible bridges which are formed so as to fracture upon removal of the closure from a container on which the closure is mounted.

3. The closure according to claim 2 wherein the frangible bridges are separated from one another by bearing zones which abut against the lower edge of the skirt when the closure is positioned on a mounting portion of a container.

4. The closure according to claim 1 wherein the valve lifter includes a convex top wall extended, in a lower part thereof, by an angular wall having a shape along an inner surface thereof which corresponds substantially to an outer surface of the upper portion of the base.

5. The closure according to claim 4 wherein the outer wall of the valve lifter includes an inner shoulder which abuts against a shoulder of the upper portion of the base when the valve lifter is in the closed position.

6. The closure of claim 3 wherein an inner surface of the outer wall of the valve lifter is, in an upper part thereof, in contact with a bead of an end zone of the upper portion of the base.

7. The closure according to claim 1 including clips inside the cap which engage a lower edge of the top wall of the valve lifter to secure the cap to the valve lifter.

* * * * *